United States Patent [19]

Foreman et al.

[11] 4,179,371

[45] Dec. 18, 1979

[54] VACUUM SEWAGE SYSTEM

[75] Inventors: Brian E. Foreman; Mark A. Jones, both of Rochester, Ind.

[73] Assignee: Burton Mechanical Contractors, Inc., Rochester, Ind.

[21] Appl. No.: 890,581

[22] Filed: Mar. 20, 1978

[51] Int. Cl.[2] ..... B01D 1/00

[52] U.S. Cl. ..... 210/63 R; 137/236 R; 210/170

[58] Field of Search ..... 210/15, 17, 70, 73 S, 210/109, 143; 170, 63 R; 137/209, 236

[56] References Cited

U.S. PATENT DOCUMENTS

| | | | |
|---|---|---|---|
| 3,115,148 | 12/1963 | Lildendahl | 137/209 X |
| 3,730,884 | 5/1973 | Burns et al. | 210/15 |

*Primary Examiner*—John Adee

*Attorney, Agent, or Firm*—Petherbridge, Lindgren & Zickert

[57] ABSTRACT

A vacuum system for transmitting intermittently injected sewage including a collection tank fed by a gravity operated sewage pipe for holding sewage at atmospheric pressure. The sewage is intermittently injected into a vacuum line under the influence of atmospheric pressure when a sewage injection valve is opened. The vacuum sewage line is connected between the injection valve and a vacuum collection tank, the vacuum collection tank having a source of vacuum pressure applied thereto. A vacuum line section is laid out in a sawtooth fashion, having a riser, a low point, and a downslope. When no sewage is being transported through the vacuum conduit, the sewage remaining in the conduit collects in the low point. The low point does not completely fill with sewage so that vacuum pressure is communicated throughout the vacuum line. When the sewage injection valve is opened, the sewage going through the vacuum line forms a hollow cylindrical mass which sweeps toward the vacuum collection tank.

6 Claims, 6 Drawing Figures

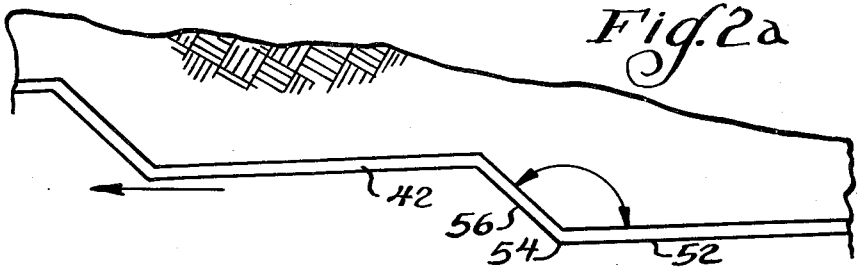
Fig. 2a
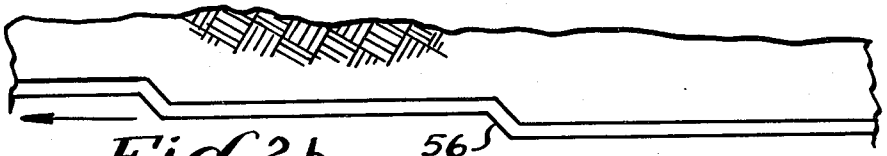
Fig. 2b
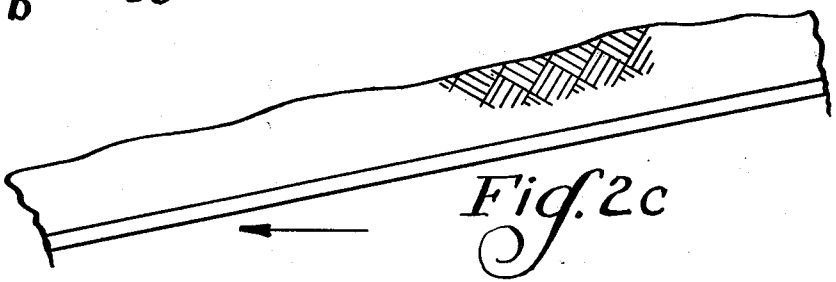
Fig. 2c
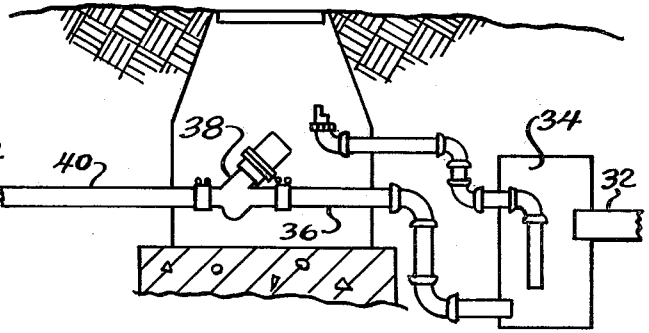
Fig. 3
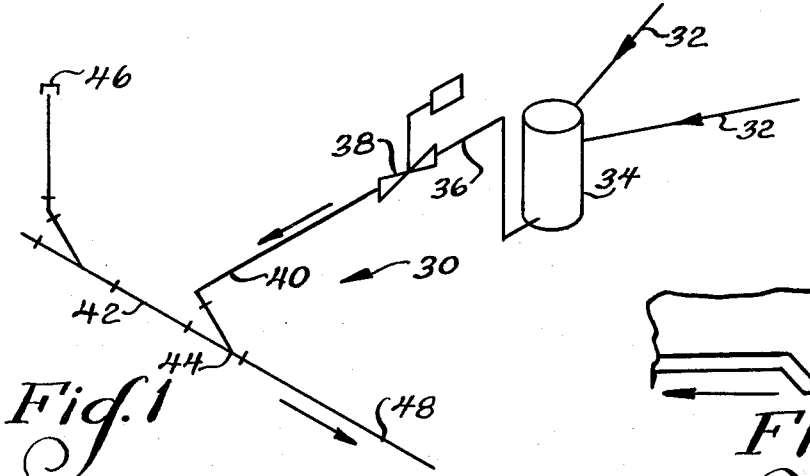
Fig. 1
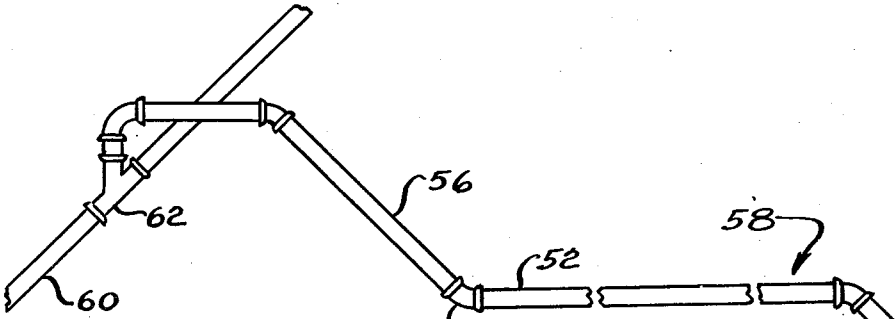

VACUUM SEWAGE SYSTEM

BACKGROUND OF THE INVENTION

The present invention relates generally to sewage systems, and more particularly, to sewage systems which utilize differential air pressure to create flow therein in contrast to conventional gravity-operated and positive pressure sewer systems.

Typical gravity-operated systems include a network of underground pipes that provide continuous downhill flow of sewage to be collected at appropriate termination points. Oftentimes a termination point is an intermediate pumping station from which sewage is pumped to a treatment facility for appropriate processing. The pumping stations, or lift stations, are utilized in order to avoid deeply burying the pipes required for a long pipe run beneath flat or irregular terrain. Many gravity sewer systems thus incorporate mechanical pumps and as a consequence are not entirely operated by gravity forces. Generally, the pipes used in gravity systems are at least eight inches in diameter or larger.

Positive pressure sewage systems do not require pipes to be laid out so as to conform to topographic features. Positive pressure systems utilize a pump to direct sewage under pressure into a collection line which feeds to an intermediate station. The pumping station then feeds a sewage treatment plant. Systems of this type use plastic pipe having smaller diameters than the vitreous tile or concrete pipe used in gravity systems. Positive pressure sewage systems also require pressure pumps to be located at every sewage input point.

As an alternative to the conventional gravity-operated and the positive pressure sewage systems of the prior art, various types of vacuum sewage systems have been proposed. U.S. Pat. No. 3,115,148 issued to S. A. J. Liljendhal describes a vacuum system for separately conveying waste products discharged from watercloset bowls, urinals, and like sanitary apparatus, while the waste products, or gray water, from bathtubs, wash basins, sinks, and the like are conveyed by a separate conventional gravity system. The waste product conduits according to the Liljendhal patent are provided with "pockets" in which sewage is collected so as to form a plug which entirely fills the cross-sectional area of the conduit. A plug of sewage is moved by a pressure differential force along a conduit in an integral condition. Note that systems according to the Liljendhal patent have two separate piping systems for transporting waste products and gray water.

U.S. Pat. No. 3,730,884 issued to B. C. Burns, et al. describes a sewage system which uses "vacuum-induced plug flow." A system according to that patent handles both waste products and gray water with one piping system. In order for a system of this type to operate, a "coherent plug" of sewage is transported by a vacuum pressure differential through a pipe for a short distance. As the plug moves through the pipe, friction and other forces cause the plug to disintegrate with the result that the pressure differential moving the plug quickly diminishes. After breakdown of the coherent plug, the formation of a new coherent plug is aided by a plug reformer which in simplest form may be a dip, or pocket, in the pipe which serves as a trap for sewage. The pockets are designed so that sewage entirely fills the pipe bore and system operation is predicted on having a plug of sewage seal the pipe bore. A system may have several pockets located at various points along a pipe. When a new plug of sewage material is first injected into such a system, the sewage plugs already contained in the pockets in the pipe are moved through the pipe. As a plug moves through the pipe it disintegrates and the remains thereof flow by gravity to nearby pockets wherein new coherent sewage plugs are reformed. This process of alternate plug disintegration and reforming continues until the sewage eventually passes completely through the pipe. Note that the available pressure differential for each of these plugs is less than the total available system pressure differential available because of the serial arrangement of the plug pockets in a pipe.

SUMMARY OF THE INVENTION

Accordingly, it is an object of the present invention to provide apparatus and a method for a plugless vacuum sewage transportation system.

Another object of the invention is to provide a sewage transport system which does not require extensive use of pumping stations to facilitate gravity flow of sewage.

Another object of the invention is to provide a sewage transportation system in which pumps are not required at each source of sewage for injecting the sewage into a collection conduit.

Another object of the invention is to provide a system and method for transporting sewage in which a single relatively small diameter pipe is used for plugless transportation of sewage without the need for plug reformers.

Another object of the invention is to provide a system and apparatus for transporting sewage which is injected into the system by a pressure differential, which system does not require the use of sewage plugs and plug reformers.

Another object of the invention is to provide a system and apparatus for transporting sewage by a vacuum pressure differential providing full pressure differential to the sewage injected into such a system.

Briefly, the invention is directed to providing apparatus and a method for transporting a sewage mass from a source of sewage to a collection means. A pressure differential is maintained between the source and the collection means. Sewage is injected into a conduit and forms a hollow cylinder. When no sewage is being transported, the conduit has substantially the same pressure throughout. Injector means are provided which, according to one aspect of the invention, is a valve opened in response to a predetermined condition. According to another aspect of the invention the conduit is laid out in a sawtooth configuration with a riser portion, a downslope portion, and a low point portion in which sewage at rest collects, permitting communication of the same pressure throughout the conduit. According to another aspect of the invention, the apparatus includes a gravity-fed sewage collection tank at atmospheric pressure having the contents thereof intermittantly injected into a vacuum-pressurized conduit laid out in sawtooth fashion, which permits full vacuum to be communicated throughout the conduit.

BRIEF DESCRIPTION OF THE DRAWINGS

FIG. 1 is a diagrammatic representation of a portion of a system according to the invention, the system having no reformer pockets formed in the piping section;

FIGS. 2a, 2b, 2c are schematic representations of a conduit according to the invention respectively showing conduits having sewage flow generally uphill, on the level, and downhill;

FIG. 3 is a side view of a portion of a system according to the invention in which a gravity-fed tank and an injection valve are located below a main vacuum conduit;

DETAILED DESCRIPTION OF THE PREFERRED EMBODIMENT

Figure 4:
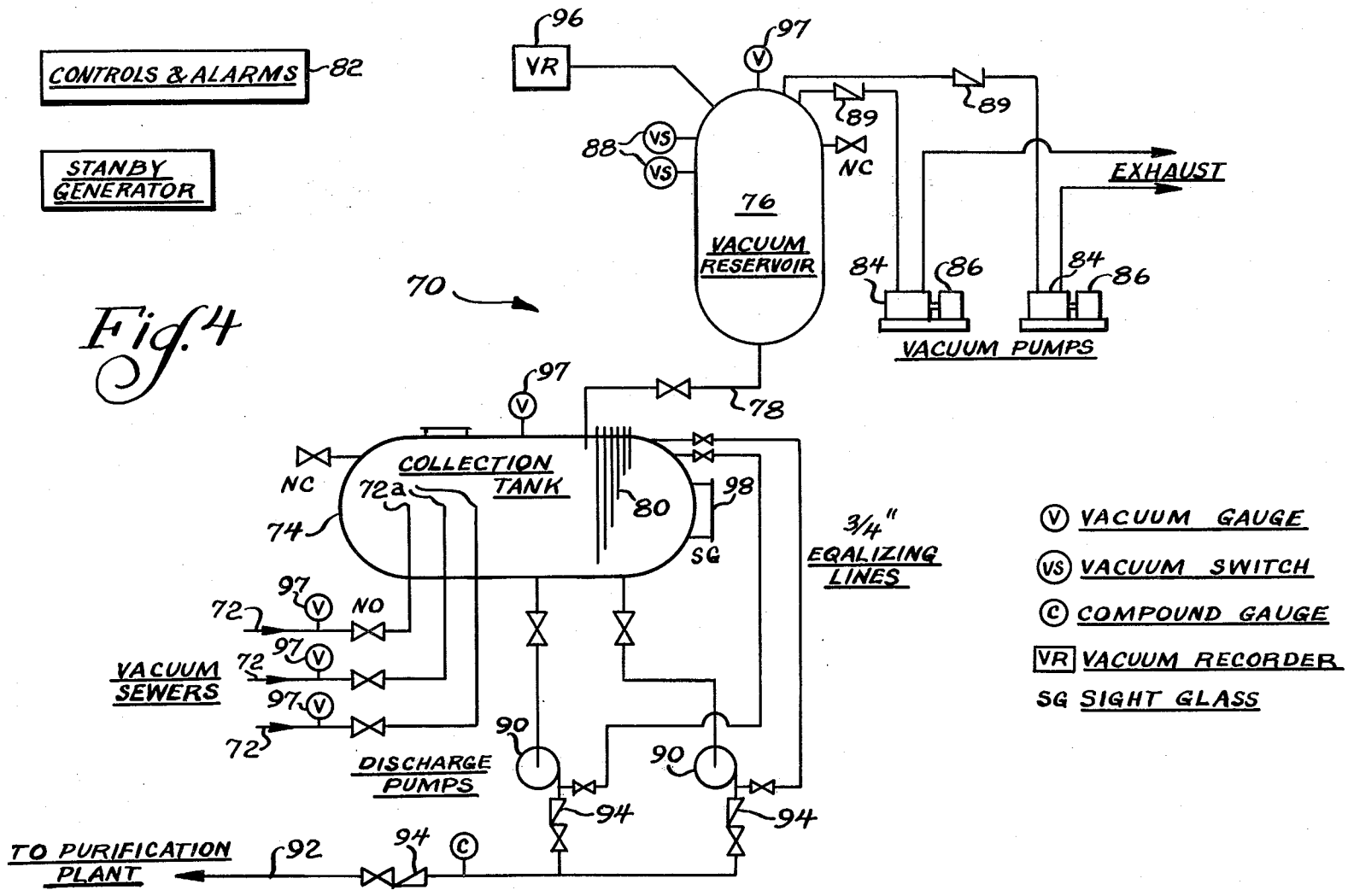
FIG. 4 is a diagrammatical representation of a vacuum collection tank and a vacuum source according to the invention.

Referring now to FIG. 1 of the drawing, a portion of a system 30 according to the invention is shown diagrammatically. Sewage from sources (not shown) is fed by gravity through pipes 32 to a gravity collection tank 34 in which the sewage is stored temporarily. An outlet pipe 36 from the gravity collection tank 34 is connected to the inlet side of a pressure differential control valve 38 similar to the valve described in a copending U.S. patent application Ser. No. 861,953 filed Dec. 19, 1977, and assigned to the assignees of the instant invention. The sewage in the gravity collection tank 34 is subjected to atmospheric pressure. In response to a predetermined system parameter, for example, a rise of the tank 34 level above a certain point, the pressure differential control valve 38 permits a volume of sewage to flow into a pipe 40. Pipe 40 is joined to a main vacuum conduit 42 at a junction point 44. The arrows shown in the figure point in the direction of flow. An access point 46 is also provided in the main vacuum conduit. A source of vacuum (not shown) is located downstream of the junction point 44. Note that the conduit portion 48 downstream from the junction point 44 is straight and has no pocket formed therein. Thus no obstacle is placed in the path of sewage swiftly passing through the pipe. The pressure differential control valve 38 is provided with timing means to maintain the valve in an open position for a period longer than that required to empty the contents of the gravity collection tank 34. This permits a quantity of atmospheric air, for example, twice the volume of sewage, to be injected into the main vacuum conduit 42 following the sewage mass. The sewage mass being transported through the conduit eventually takes the form of a hollow cylinder with the force initially exerted thereupon provided by the differential between atmospheric pressure and the reduced pressure of the vacuum source. As the sewage mass flows through the conduit, air pushes through the mass forming a hollow cylinder which continues moving through the conduit.

Referring to FIGS. 2a, 2b, and 2c conduit sections for facilitating the flow of sewage in the directions of the arrows shown, respectively, uphill, on the level, and downhill are represented. When the flow proceeds uphill as in FIG. 2a, the vacuum conduit 42 as shown has a very slight downward sloping portion 52, a low point portion 54, and a riser portion 56. Remnants of the sewage which are not swept through the conduit 42 flow to and accumulate in the low point portion 54. The conduits as shown in FIGS. 2a, and 2b are laid out in generally sawtooth configurations as shown. With the sawtooth arrangement the sewage does not seal the conduit 42 bore when the sewage motion has ceased. This permits the same vacuum pressure to be distributed throughout the whole conduit, including that portion of the conduit above the material in the low portion 54 of the conduit. The reduced pressure from the vacuum source is distributed throughout the main conduit 42 because the sewage does not form into plugs which seal the bore of the conduit, permitting full vacuum differential pressure to be applied to sewage entering the vacuum system through the pressure differential control valve 38. This results in sewage velocities of from fifteen to eighteen feet per second, for example, when a ten to fifteen gallon volume of sewage enters such a system. The sewage, as previously mentioned, eventually takes the form of a hollow cylinder traveling through the conduit. The force of the sewage with the atmospheric air traveling behind it lifts all sewage trapped in the low point portions 54 up through the riser portions 56. FIG. 2b shows a system configured for essentially level terrain having a somewhat shorter riser portion 56. FIG. 2c shows a system pipe for descending terrain and has no lift, or riser, portion. Various combinations of sections as shown in the figure may be utilized as required to form a multi-section system laid beneath irregular terrain.

FIG. 3 shows pictorial representation of the system shown in FIG. 2a, wherein like numbers represent similar system elements. A feeder vacuum conduit 58 having low point portions 54, riser portions 56, and downslope portions 52 provides lift as sewage is injected from the gravity collection tank 34 towards a main vacuum conduit 60 which is elevated above the gravity collection tank 34 as shown. The main vacuum conduit 60 is provided with reduced pressure by an appropriate vacuum source (not shown). Vacuum sewer main conduit 60, branches, and feeder conduit 58 may be constructed of, for example, polyvinyl chloride (PVC) or acrylonitrile-butadiene-styrene (ABS) plastic pipe. Joints may be solvent welded or provided with fittings having suitable vacuum-tight compression rings, as known in the art. For an installation with high sewage temperature fiberglass pipe is used. Pipe sizes generally range between three and six inches in diameter. When lifts are required, the pipe downslopes are installed with a minimum slope of 0.2% between lift sections. Branch connections 62 to a main conduit 60 are made with vertical wye and ninety degree ell as shown. When sewage is injected into a conduit junction, some of the sewage initially moves in a reverse direction to the normal flow direction. The minimum slope of 0.2% in the downslope causes the backflow sewage to collect at a low point.

Referring to FIG. 4 of the drawing, a collection station 70 for receiving the sewage from several vacuum conduits 72 is shown. A vacuum collection tank 74 for receiving the sewage from the vacuum conduits 72 may be fabricated, for example, from welded steel or fiberglass. A vacuum reservoir 76 serves as a source of vacuum for the collection tank 74 and the main vacuum conduits 72, the vacuum reservoir 76 communicating with the collection tank by means of a vacuum connecting pipe 78. Level control probes 80 are provided in the sewage vacuum collection tank 74 for providing sewage depth information in the collection tank 74 to the controls and alarms circuitry 82 by appropriate connection means (not shown). Controls and alarms circuit 82 has output signals (not shown) which provide appropriate control signals for the various system components, as required. Vacuum pumps 84 driven by appropriately controlled motors 86 maintain between 16 and 20 inches of mercury vacuum in the vacuum reservoir 76 with the aid of the vacuum switches 88 and check valves 89. The vacuum pumps 84 may be, for example, of either the liquid ring or the sliding vane type known in the art. The discharge pumps 90 in conjunction with the level control probes 80 and the controls and alarms circuitry 82 are activated to empty the vacuum collection tank 74 contents into a pressurized sewage line 92 which feeds the sewage to an appropriate purification plant. The sewage level in collection tank 74 is always maintained at a level below the upwardly extending ends 72*a* of the vacuum conduits 72. This provides unobstructed communication of vacuum pressure from the reservoir 76 to the conduits 72 at all times. The discharge pumps 90 may be, for example, vertical, open impeller, non-clog types which have mechanical shaft seals and pressurized oil seals. Check valves 94 are installed in the discharge pump outlets and the pressurized sewage line 92. Appropriate shut-off valves are provided as shown in the collection station 70 diagrammatic representation. Alarm circuitry and indicators are included as part of circuitry 82. A vacuum recorder 96 and vacuum gauges 97 are provided to monitor vacuum pressure. A sight glass 98 is also provided for determining the sewage level within the vacuum collection tank 74.

While a particular embodiment of the invention has been shown and described, it should be understood that the invention is not limited thereto since many modifications may be made. It is therefore contemplated to cover by the present application any and all such modifications which fall within the true spirit and scope of the basic underlying principles disclosed and claimed herein.

What is claimed is:

1. An improved vacuum sewage system for transporting sewage from a source at a given air pressure comprising:

vacuum collection means for receiving sewage and having a pressure less than the pressure of the source;

sewage injection means having an inlet coupled to the source of sewage and having an outlet for injecting the sewage and air; and conduit means coupled to the vacuum collection means and coupled to the outlet of the injection means, said conduit means having at least one riser, low point, and downslope, and being laid out in sawtooth fashion between the collection means and the injection means outlet so that when no flow occurs sewage collects in the low point and permits the same pressure to be distributed throughout the conduit means.

2. The system of claim 1 wherein the source of sewage includes a gravity-fed sewage holding tank and wherein the injection means is opened in response to a predetermined system condition.

3. The system of claim 2 wherein the sewage in the holding tank is exposed to atmospheric pressure and wherein the vacuum collection means is maintained at less than atmospheric pressure.

4. An improved method of transporting air and sewage through a vacuum sewage system comprising:

laying a vacuum conduit in a sawtooth fashion having a bore and having at least one riser, low point, and downslope so that when no flow is occurring the low point contains sewage and the downslope and riser are air filled with the conduit not being sealed and air flow being allowed above the sewage in the low point to permit full vacuum to be distributed throughout the pipe;

providing a valve at one end of the conduit and opening the valve to admit sewage from a source of sewage into the conduit, the sewage forming a hollow cylindrical mass which sweeps through the conduit from the valve end thereof towards the collection means; and holding the valve open a predetermined time after the sewage has been admitted to permit a quantity of air to enter.

5. The method of claim 4 wherein atmospheric pressure is provided on the sewage in the sewage source and wherein a partial vacuum is provided at the collection means.

6. An improved vacuum sewage system for transporting an intermittently injected sewage mass comprising:

at least one gravity-fed sewage pipe;

a collection tank fed by the gravity-fed sewage pipe for holding sewage, said sewage exposed to atmospheric pressure;

an intermittently operated sewage injection valve having an inlet and an outlet, said inlet coupled to the collection tank;

a source of vacuum pressure;

a vacuum collection tank having an inlet and having vacuum pressure applied thereto from the source of vacuum pressure;

a conduit section coupled between the sewage injection valve outlet and the collection tank for transporting sewage in the form of a hollow cylinder, said conduit means being laid out in a sawtooth fashion, having at least one riser, low point, and downslope so that when no injected sewage mass is being transported therein the low point collects sewage and permits vacuum pressure to be communicated throughout the conduit section.

* * * * *